United States Patent [19]

Farrell

[11] 4,141,109

[45] Feb. 27, 1979

[54] HINGE SUPPORT ASSEMBLY

[76] Inventor: Thurlow Farrell, 5758 N. Williamston Rd., Williamston, Mich. 48895

[21] Appl. No.: 883,572

[22] Filed: Mar. 6, 1978

[51] Int. Cl.[2] ..... E05D 11/00

[52] U.S. Cl. ..... 16/137; 16/169; 248/289 R; 403/85; 403/119

[58] Field of Search ..... 16/129, 134, 137, 138, 16/168, 169; 248/289 R, 289 A, 291; 403/85, 119

[56] References Cited

U.S. PATENT DOCUMENTS

| | | | |
|---|---|---|---|
| 2,143,275 | 1/1939 | Lickteig | 16/168 X |
| 2,166,815 | 7/1939 | Jones | 16/137 |
| 2,566,486 | 9/1951 | Grawlik | 16/169 |
| 3,263,269 | 8/1966 | McGahee | 16/169 |
| 3,913,171 | 10/1975 | Reid | 16/137 X |

*Primary Examiner*—Werner H. Schroeder
*Assistant Examiner*—Moshe I. Cohen
*Attorney, Agent, or Firm*—Miller, Morriss and Pappas

[57] ABSTRACT

An adjustable hinge support assembly for supportably engaging the pintle of a hinge so as to reinforceably maintain the pintle in its fixed vertically oriented operative use position. Spaced-apart pairs of pintle-engaging support arms are provided in association with a hinge. Vertically oriented angle iron wall jamb and door anchor members are positioned along and spaced apart from the hinge. Each pair of support arms is comprised of a first pintle-engaging support arm and a second pintle-engaging support arm. The first pintle-engaging support arm is provided at one end thereof with a pintle-engaging gudgeon portion having an opening therethrough and with a threaded wall jamb anchor member-engaging portion at the opposite end thereof. The second pintle-engaging support arm is provided at one end thereof with a pintle-engaging gudgeon portion having an opening therethrough and with a threaded door anchor member-engaging portion at the opposite end thereof. The openings of the gudgeon portions of the support arms are positioned in vertical abutting aligned register with each other so as to slidably receive the pintle of the hinge therethrough so as to reinforceably maintain the pintle in its fixed vertically oriented operative use position against any unusual load forces which might be applied to the door upon which the hinge is mounted. The threaded wall jamb anchor member-engaging and door anchor member-engaging portions are adjustably connected to the wall jamb and door anchor members, respectively.

3 Claims, 7 Drawing Figures

HINGE SUPPORT ASSEMBLY

SUMMARY OF THE INVENTION

This invention relates to an adjustable hinge support assembly having pintle-engaging support arm elements which cooperate to supportably engage the pintle of a hinge so as to maintain the pintle in its fixed vertically oriented operative use position and which are respectively adjustably anchored to the door and jamb upon which the hinge is mounted so that corrective alignment of the door within the door jamb can be made as required. More specifically, spaced-apart pairs of pintle-engaging support arms are provided in association with a hinge. Each pair of support arms is comprised of a first pintle-engaging support arm and second pintle-engaging support arm. The first pintle support arm is provided at one end thereof with a pintle-engaging gudgeon portion having an opening therethrough and with a threaded wall jamb anchor member-engaging portion at the opposite end thereof. The second pintle-engaging support arm is provided at one end thereof with a pintle-engaging gudgeon portion having an opening therethrough and with a threaded door anchor member-engaging portion at the opposite end thereof. In use, the openings of the gudgeon portions of the pintle-engaging support arms are positioned in vertical abutting aligned register with each other so as to slidably receive the pintle of the hinge therethrough so as to reinforceably maintain it in its fixed vertically oriented operative use position against any unusual load forces which might be applied to the door. Further, the threaded wall jamb and door anchor member-engaging portions of the pintle support arms are adjustably connected to the wall jamb and door anchor members so that corrective alignment of the door within the door frame can be made as required. It is within the scope of the invention to provide a heavy duty hinge which has the hinge support assembly incorporated thereinto as an integral part thereof.

PRIOR ART

Nowhere in the known prior art is there shown an adjustable hinge support assembly which utilizes pintle-engaging support arm elements that cooperate to supportably engage the pintle of the hinge so as to reinforceably maintain the pintle in its fixed vertically oriented operative use position against any unusual load forces which might be applied to the door. Further, nowhere in the prior art are there shown adjustable hinge support arms which can be adjusted so that corrective alignment can be made of the door within the door frame as required. Examples of the known prior art are seen in the U.S. Patent to Shields, No. 170,598, Holy, No. 704,541, Ferris, No. 2,137,529, Lickteig, No. 2,143,275 and Gawlik, No. 2,566,486.

A need has therefore existed for a hinge support assembly which supports a hinge against unusual load forces that might be applied to the door. This problem is particularly acute in schools and student dormitories where students often swing on the doors so as to cause damage to the hinges thereof.

A further need has existed for an adjustable hinge support assembly which has pintle-engaging support arms which can be selectively adjusted so as to permit corrective alignment of a door within the door frame in which it is mounted.

It is therefore an object of this invention to provide a hinge support assembly which supportably engages the pintle of a hinge so as to reinforceably maintain the pintle in its fixed vertically oriented operative use position against any unusual load forces which might be applied to the door.

It is a further object of this invention to provide an adjustable hinge support assembly which can be selectively adjusted so as to permit corrective alignment of a door within the door frame as required.

Other objects of this invention will be apparent to those skilled in the art upon reading the present description, drawings and claims.

IN THE DRAWINGS

DESCRIPTION

Figure 1:
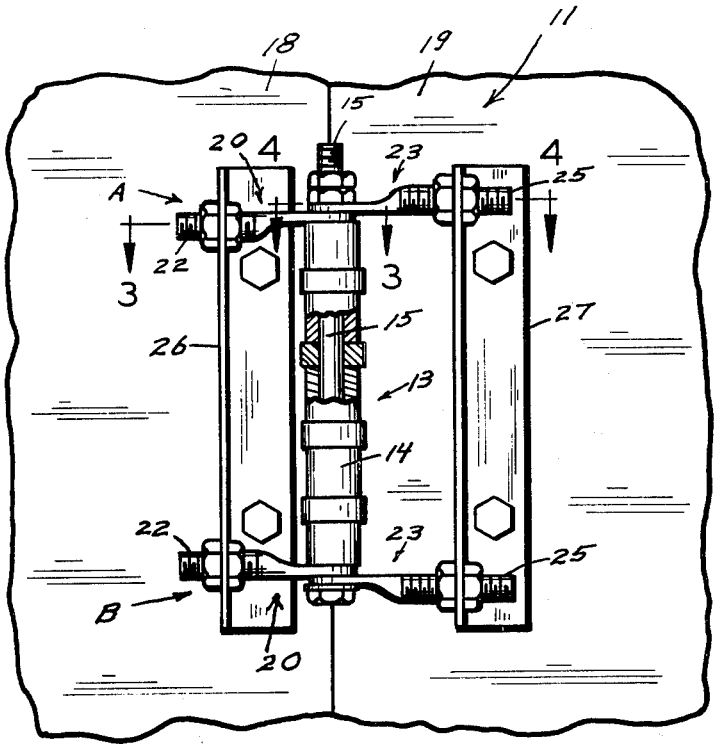
FIG. 1 is a front elevation view of the hinge support assembly in its operative use position in association with a hinge.
Figure 2:
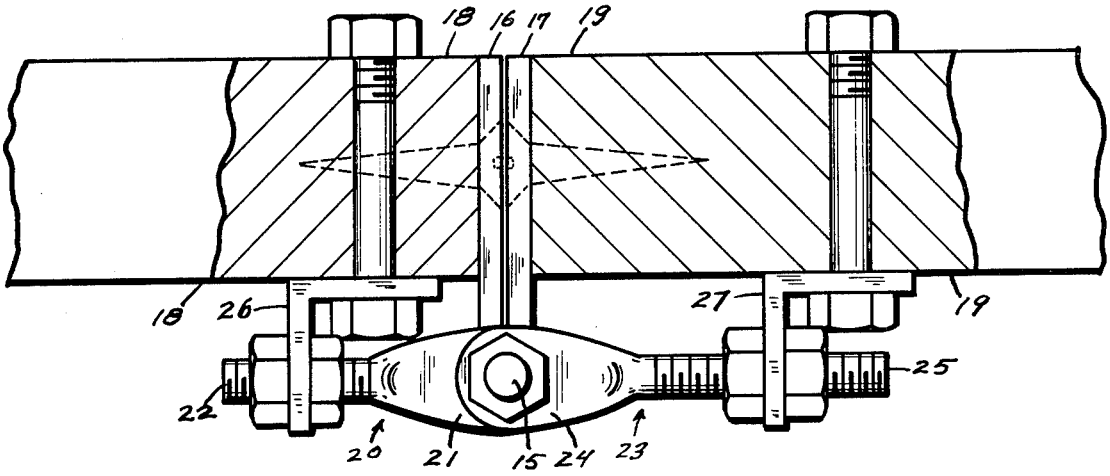
FIG. 2 is a top view thereof with portions of the wall jamb and door broken away for purposes of clarity.
Figure 3:
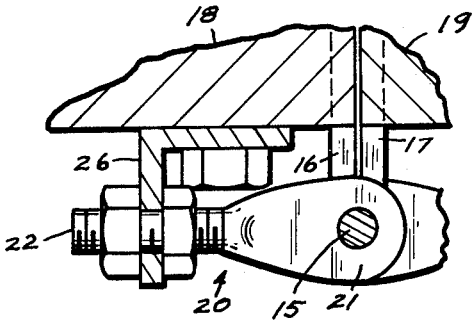
FIG. 3 is a cross-sectional view of the hinge support assembly taken on line 3—3 of FIG. 1 and showing the first pintle-engaging support arm anchored to the wall jamb anchor member.
Figure 4:
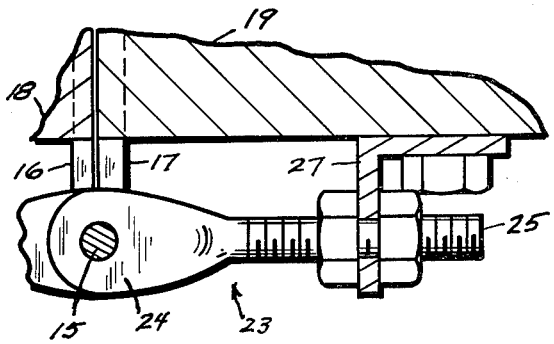
FIG. 4 is a cross-sectional view of the hinge support assembly taken on line 4—4 of FIG. 1 and showing the second pintle-engaging support arm anchored to the door anchor member.
Figure 5:
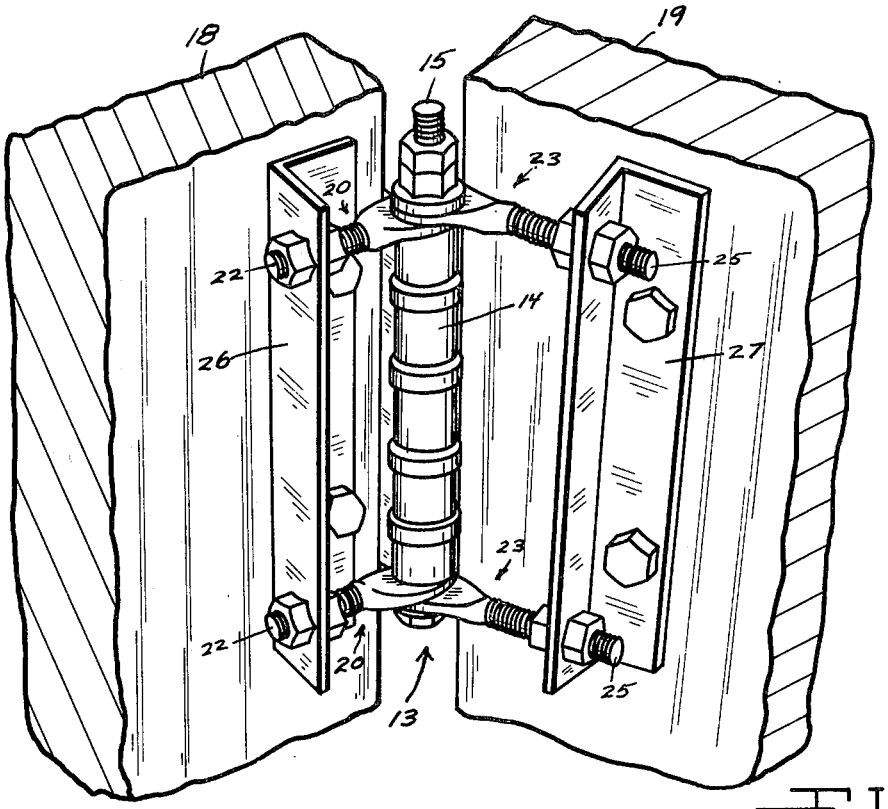
FIG. 5 is a front perspective view of the hinge support assembly in association with a hinge and showing the door in an open position.
Figure 6:
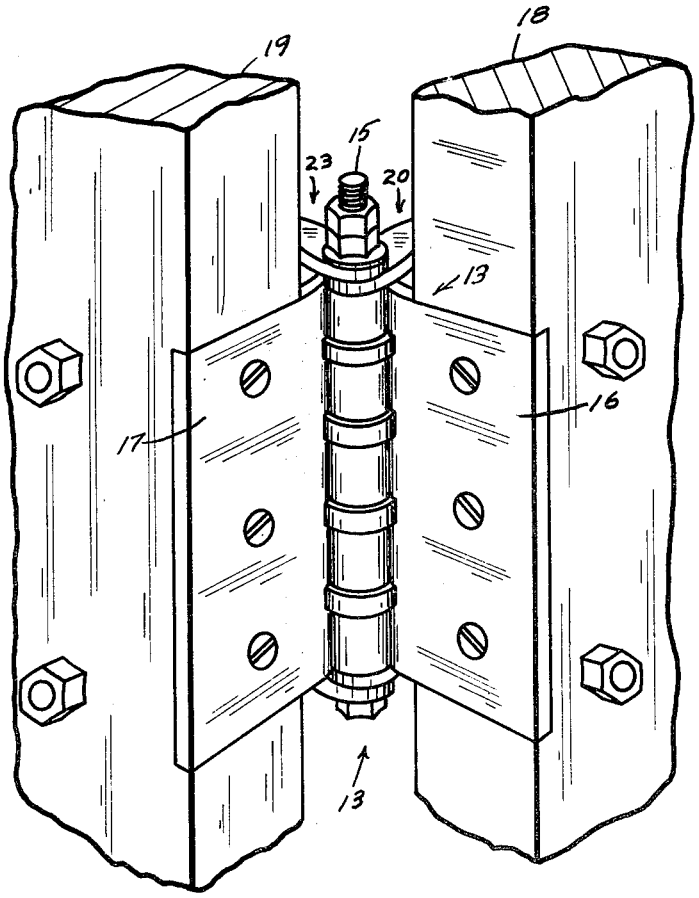
FIG. 6 is a rear perspective view showing the hinge and a portion of the hinge support assembly in association therewith.
Figure 7:
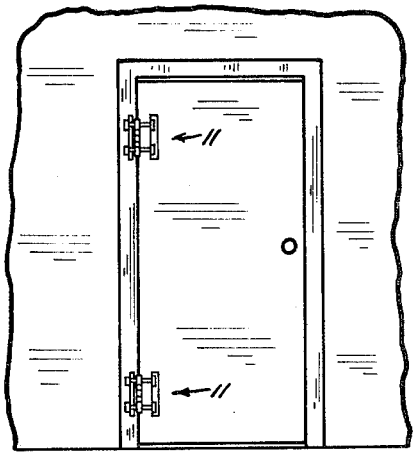
FIG. 7 is a front elevation view of a door having hinges provided with hinge support assemblies in association therewith.

As shown generally in the drawings and more specifically in FIGS. 1, 2 and 5, a hinge support assembly 11 is provided in association with a door hinge 13. The door hinge 13 is provided with hinge gudgeon portions 14 which define openings through which a pintle 15 is slidably mounted. The hinge 13 is provided with hinge plates 16 and 17 which are attached to the wall jamb 18 and the door 19, respectively. In the preferred embodiment of the invention, the hinge support assembly 11 comprises two spaced-apart pairs of pintle-engaging support arms A and B, respectively. However, it is within the scope of the invention to utilize a single pair of centrally positioned support arms in association with a hinge or three or more spaced-apart pairs of support arms in association with a single hinge as might be required by the unusual loads that might be placed upon the door.

Each pair of support arms A and B comprises a first pintle support arm 20 which is provided with a pintle-engaging gudgeon portion 21 defining an opening therethrough at one end thereof and a threaded wall jamb anchor member-engaging portion 22 at the opposite end thereof. The second pintle support arm 23 is provided with a pintle-engaging gudgeon portion 24 defining an opening therethrough at one end thereof and a threaded door anchor-engaging portion 25 at the opposite end thereof.

As shown in FIGS. 2 through 5, the support arms 20 and 23 are anchored to the wall jamb 18 and door 19 by fixed but adjustable engagement with angle iron wall jamb and door mounted anchor members 26 and 27, respectively.

As shown, the pair of spaced-apart vertically oriented angle iron anchor members 26 and 27 are mounted on the wall jamb 18 and door 19, respectively, so as to be spaced-apart from and bracket the hinge 13 therebetween. The anchor members 26 and 27 are provided with openings therethrough which retainably and adjustably engage the wall jamb anchor-engaging portion 22 and the door anchor-engaging portion 25, respectively, of the pintle-engaging support arms 20 and 23. Thus mounted, the alignment of the door can be corrected as required by threadably adjusting the support arms in relation to their respective anchor members. For instance and with reference to FIG. 1, if the door 19 has been sprung or pulled away from the jamb 18, the threaded door anchor-engaged portion 25 of support arms 23 could be adjusted in relation to the door mounted anchor member 27 so as to pull the door back into alignment. If the pintle had been pulled out of its vertically aligned operative use position, it could be correctively aligned by suitable adjustment of the support arms in relation to the anchor members.

It is considered to be within the scope of the invention that the wall jamb-engaging portion 22 of the support arm 20 be configured so that it can be directly affixed to the wall jamb in its operative use position thereby eliminating the need for the angle iron anchor member 26. Similarly, the door-engaging portion 25 of the pintle support arm 23 can be configured so that it can also be anchored directly to the door 19.

As shown in the drawings, the pintle-engaging support arms 20 and 23 are positioned so that their respective pintle-engaging gudgeon portions 21 and 24 are in a vertically stacked abutting relationship whereby the openings thereof are in vertically oriented aligned register so as to slidably receive the pintle 15 of the hinge 13 therethrough. Thus, each spaced-apart pair of support arms A and B supportably engages the pintle 15 so as to reinforceably maintain it in its fixed vertically oriented operative use position against any unusual load forces which might be applied to the door. The pairs of support arms A and B do not in any way interfere with the normal operation of the hinge 13. The support arms 20 and 23 merely serve to stabilize the pintle 15 in its normal vertically oriented operative use position so as to prevent damage to the hinge 13 if abnormal loading forces are applied to the door, i.e. as by students swinging thereon. In the preferred embodiment, the pintle 15 is provided with a flange head portion which engages the lowermost support arm when the pintle is in its operative use position extending upwardly through the hinge and support arm openings. The pintle 15 is threaded at the opposite end thereof so as to engage nut means which hold it in its use position. It is within the scope of the invention to install the pintle 15 so that it extends downwardly through the hinge and support arms and/or to retain the pintle in its operative use position by any other known fastening means or structures.

It is thus seen that an adjustable hinge support assembly is provided in association with a door-mounted hinge for supportably engaging the pintle of the hinge so as to maintain it in its vertically oriented operative use position. A vertically oriented wall jamb and anchor member is mounted on the wall jamb adjacent the hinge. A vertically oriented door anchor member is mounted on the door adjacent the hinge in a spaced-apart parallel relationship with the wall jamb anchor member. At least one pair of oppositely extending horizontally oriented pintle-engaging support arms are provided in association with a door hinge. The pair of support arms comprises a first pintle-engaging support arm and a second pintle-engaging support arm. The first pintle-engaging support arm is provided at one end thereof with a first gudgeon portion defining an opening therethrough and at the opposite end thereof with a threaded wall jamb anchor-engaging portion adapted to be fixedly but adjustably connected to the wall jamb anchor mounted on the wall jamb adjacent the hinge. The second pintle-engaging support arm is provided at one end thereof with a second gudgeon portion defining an opening therethrough and at the opposite end thereof with a threaded door anchor-engaging portion adapted to be fixedly but adjustably connected to the door anchor mounted on the door adjacent the hinge. The first gudgeon portion and the second gudgeon portion are positioned in a vertically stacked abutting relationship so that the openings thereof are in a vertically aligned register so as to slidably receive a pintle of a hinge therethrough so as to reinforceably retain the pintle in its vertically oriented operative use position. As stated previously, another embodiment of the invention is to provide two vertically spaced-apart pairs of pintle-engaging support arms so as to supportably engage the pintle of a hinge positioned therebetween.

It is thus within the scope of the invention to provide a pair of vertically oriented parallel spaced-apart angle iron anchor members in association with the hinge support assembly and a hinge positioned in association therewith. A first angle iron anchor member is provided which is adapted to fixedly engage a wall jamb adjacent the hinge attached thereto. A second angle iron anchor member is provided which is adapted to fixedly engage a door adjacent the hinge attached thereto. The first angle iron anchor member is adapted to fixedly but adjustably engage the wall jamb anchor-engaging portion of the first pintle-engaging support arm and the second angle iron anchor member is adapted to fixedly but adjustably engage the door anchor-engaging portion of the second pintle-engaging support arm.

It should be noted that it is within the scope of this invention that a hinge structure is provided which incorporates the hinge support assembly as an integral part thereof. Thus, a hinge structure is provided with pintle-engaging support arms extending therefrom into selective fixed but adjustable engagement with the anchor members provided on the wall jamb and door upon which the hinge is mounted. The hinge structure is provided with hinge plates which are adapted for selective engagement with a wall jamb and a door. The hinge structure is provided with gudgeon portions which define pintle-receiving openings therethrough. A pintle is provided through the pintle-receiving openings of the hinge, the pintle is of sufficient length so as to extend vertically above and below the hinge structure. A vertically oriented wall jamb anchor member is mounted on the wall jamb parallel to and spaced-apart from the hinge. A vertically oriented door anchor member is mounted on the door adjacent the hinge and in a spaced-apart parallel relationship with the wall jamb anchor member. Horizontally oriented upper and lower pairs of pintle-engaging support arms are provided in abutting contact with the hinge structure positioned therebetween. Each of the pairs of pintle-engaging support arms consist of a first pintle-engaging support arm and a second pintle-engaging support arm. The first pintle-engaging support arm is provided at one end thereof with a first gudgeon portion defining an opening therethrough and at the opposite end thereof with a threaded wall jamb anchor-engaging portion adapted to be fixedly but adjustably connected to a wall jamb anchor member. The second pintle-engaging support arm is provided at one end thereof with a second gudgeon portion defining an opening therethrough and at the opposite end thereof with a door anchor-engaging portion adapted to be fixedly but adjustably connected to a door anchor member. The first gudgeon portion of the first support arm and the second gudgeon portion of the second support arm are positioned in a vertically stacked abutting relationship with the hinge so that the openings thereof are in vertically aligned register with the openings of the hinge gudgeon portions so as to slidably receive the pintle therethrough so as to reinforceably retain said pintle in its vertically oriented operative use position. Thus, a pair of vertically oriented parallel spaced-apart angle iron anchor members are provided for selective mounting on the wall jamb and door so as to bracket the hinge therebetween. The pair of angle iron anchor members consist of a first angle iron anchor member and a second angle iron anchor member. The first angle iron anchor member is adapted to fixedly engage the wall jamb adjacent to and spaced-apart from the hinge. Thus positioned, the first angle iron anchor member is adapted to fixedly but adjustably engage the wall jamb anchor-engaging portion of each of the first pintle-engaging support arms. The second angle iron anchor member is adapted to fixedly engage the door adjacent to and spaced-apart from the hinge. Thus positioned, the second angle iron anchor member is adapted to fixedly but adjustably engage the door anchor-engaging portion of each of the second pintle-engaging support arms.

It should be noted the threaded portions of the support arms are adjustably connected to the anchor members so as to give the hinge support assembly an adjustment capability which permits selective realignment of a door or hinge pintle which has been sprung out of position due to unusual load forces applied thereto.

The hinge support assembly can be used on either right or left hand doors as necessary.

From this presentation of an operative embodiment of my invention, improvements, modifications and substitutions will become apparent to those skilled in the art. Such improvements, modifications and substitutions are intended to be included within the spirit of the invention limited only by the scope of the hereinafter appended claims.

I claim:

1. In an adjustable hinge support assembly in association with a door mounted hinge for supportably engaging the pintle of the hinge so as to maintain it in its vertically oriented operative use position, the combination comprising:

a vertically oriented wall jamb anchor member mounted on the wall jamb adjacent the hinge;

a vertically oriented door anchor member mounted on the door adjacent the hinge in spaced-apart parallel relationship with said wall jamb anchor member;

at least one pair of oppositely extending horizontally oriented pintle-engaging support arms in association with a door hinge comprising a first pintle-engaging support arm and second pintle-engaging support arm, said first pintle-engaging support arm provided at one end thereof with a gudgeon portion defining an opening therethrough and at the opposite end thereof with a threaded wall jamb anchor-engaging portion adapted to be fixedly but adjustably connected to said wall jamb anchor member, said second pintle-engaging support arm provided at one end thereof with a gudgeon portion defining an opening therethrough and at the opposite end thereof with a threaded door anchor-engaging portion adapted to be fixedly but adjustably connected to said door anchor member, said gudgeon portions positioned in a vertically stacked abutting relationship so that said openings thereof are in vertically aligned register so as to slidably receive a pintle of a hinge therethrough so as to reinforceably retain the pintle in its vertically oriented operative use position.

2. In the hinge support assembly of claim 1 wherein two vertically spaced-apart pairs of pintle-engaging support arms are provided to supportably engage the pintle of a hinge in association therewith.

3. In a hinge structure provided with pintle-engaging support arms extending therefrom into selective fixed but adjustable engagement with the wall jamb and door anchor members mounted on the wall jamb and door upon which the hinge is mounted, the combination comprising:

a hinge structure, said hinge structure provided with hinge plates adapted for selective engagement with a wall jamb and a door, said hinge structure provided with hinge gudgeon portions defining pintle-receiving openings therethrough;

a pintle provided through said pintle-receiving openings of said hinge, said pintle extending above and below said hinge structure;

a vertically oriented wall jamb anchor member mounted on the wall jamb parallel to and spaced-apart from said hinge;

a vertically oriented door anchor member mounted on the door adjacent to said hinge and in a spaced-apart parallel relationship with said wall jamb anchor member;

upper and lower pairs of pintle-engaging support arms in abutting contact with said hinge structure positioned therebetween, each of said pairs of pintle-engaging support arms comprising a first pintle-engaging support arm and a second pintle-engaging support arm, said first pintle-engaging support arm provided at one end thereof with a gudgeon portion defining an opening therethrough and at the opposite end thereof with a threaded wall jamb anchor-engaging portion adapted to be fixedly but adjustably connected to said wall jamb anchor member, said second pintle-engaging support arm provided at one end thereof with a gudgeon portion defining an opening therethrough and at the opposite end thereof with a threaded door anchor-engaging portion adapted to be fixedly anchored to said door anchor member, said gudgeon portion of said first support arm and said gudgeon portion of said second support arm positioned in a vertically stacked abutting relationship with said hinge so that the openings thereof are in vertically aligned register with the said openings of said hinge gudgeon portions so as to slidably receive said pintle therethrough so as to reinforceably retain said pintle in its vertically oriented operative use position.

* * * * *